US008389188B2

(12) United States Patent
Kim et al.

(10) Patent No.: US 8,389,188 B2
(45) Date of Patent: Mar. 5, 2013

(54) TONER USING RESIN HAVING ACTIVE HYDROGEN-CONTAINING GROUP AND METHOD OF PREPARING THE SAME

(75) Inventors: Dong Won Kim, Daejeon (KR); Woo Young Yang, Daejeon (KR); Keon Il Kim, Daejeon (KR); Dae Il Hwang, Daejeon (KR); Il Hyuk Kim, Daejeon (KR); Jae Bum Park, Daejeon (KR); Il Sun Hwang, Daejeon (KR); Jae Kwang Hwang, Daejeon (KR); Dae Woong Choi, Daejeon (KR); Duck Kyun Ahn, Daejeon (KR)

(73) Assignee: Samsung Fine Chemicals Co., Ltd., Ulsan (KR)

( * ) Notice: Subject to any disclaimer, the term of this patent is extended or adjusted under 35 U.S.C. 154(b) by 357 days.

(21) Appl. No.: 12/739,699

(22) PCT Filed: Oct. 22, 2008

(86) PCT No.: PCT/KR2008/006252

§ 371 (c)(1),
(2), (4) Date: Apr. 23, 2010

(87) PCT Pub. No.: WO2009/054676

PCT Pub. Date: Apr. 30, 2009

(65) Prior Publication Data

US 2010/0239972 A1 Sep. 23, 2010

(30) Foreign Application Priority Data

Oct. 24, 2007 (KR) ..... 10-2007-0107415

(51) Int. Cl.
*G03G 9/087* (2006.01)

(52) U.S. Cl. ..... 430/109.4; 430/110.1; 430/137.14

(58) Field of Classification Search ..... 430/109.4, 430/110.1, 137.14
See application file for complete search history.

(56) References Cited

U.S. PATENT DOCUMENTS 5,352,556 A * 10/1994 Mahabadi et al. ..... 430/110.1
2004/0067430 A1 4/2004 Terauchi et al.

FOREIGN PATENT DOCUMENTS

JP 2001117268 A 4/2001
JP 2006038915 A 2/2006
KR 1020020018931 A 3/2002
KR 1020020044184 A 6/2002
KR 1020070077044 A 7/2007

OTHER PUBLICATIONS

Diamond, A.S., et al., ed., Handbook of Imaging Materials, Second Edition, Marcel Dekker, Inc., NY (2002), pp. 146-148.*
International Search Report, PCT/KR2008/006252, dated Jun. 2, 2009.

* cited by examiner

*Primary Examiner* — Janis L Dote
(74) *Attorney, Agent, or Firm* — Nixon Peabody LLP

(57) ABSTRACT

Provided are a toner using a resin having an active hydrogen-containing group, and a method of preparing the toner. The toner using a resin having an active hydrogen-containing group includes a binder resin (A), a cross-linked resin including a THF insoluble content of 99-100 weight %, a colorant, and at least one additive. The cross-linked resin is arranged in the form of a plurality of islands in each particle of the toner.

14 Claims, No Drawings

TONER USING RESIN HAVING ACTIVE HYDROGEN-CONTAINING GROUP AND METHOD OF PREPARING THE SAME

CROSS-REFERENCE TO RELATED PATENT APPLICATION

This application is a national phase International Application No. PCT/KR2008/006252, entitled, "Toner Using Resin Having Active Hydrogen-Containing Group And Method Of Preparing The Same", which was filed on Oct. 22, 2008, and which claims priority of Korean Patent Application No. 10-2007-0107415, filed Oct. 24, 2007, in the Korean Intellectual Property Office.

TECHNICAL FIELD

An illustrative embodiment of the present invention relates to a toner and a method of preparing the same, and more particularly, to a toner using a resin that has an active hydrogen-containing group and is capable of preventing hot offset, and a method of preparing the toner.

BACKGROUND ART

Recently, the need for toner suitable for high-speed printing, particularly toner capable of improving image quality and preventing hot offset has increased in the printing industry. "Hot offset" is a phenomenon in which some toner melted on a printing paper adheres to a fixing device after passing through the fixing device in the case where excessive amounts of toner are melted when the toner is heated while passing through the fixing device.

Thus, a toner having anti-hot offset properties is required.

Japanese Patent Publication No. 2001-117268 discloses a toner having binder resin particles that contain crystalline polyester with a cross-linking structure formed with unsaturated portions as main components and having spherical shape, and a method of preparing the toner. However, it is difficult to provide a large fixing temperature range using the toner.

Meanwhile, when a pulverization method is used to improve anti-hot offset properties, a resin cannot be used efficiently, and even when a polymer having a high molecular weight or a cross-linking structure is used, it is difficult to obtain sufficient performance. Also, since the pulverization method is used, it is difficult to control the shape of the toner particles; in particular, it is difficult to obtain spherical toner particles. Also, it is difficult to obtain toner particles with small diameters, which is required for high image quality.

Japanese Patent Publication No. 2006-038915 discloses a method of preparing a toner for solving the above-described problem relating to the pulverization method, wherein the method includes preparing a water suspension of polyester resin, adding a dispersion stabilizer to the water suspension, and adding an aqueous electrolyte solution in the presence of the dispersion stabilizer, thereby precipitating fine particles of a polyester resin in a form of coalescence. The polyester resin used in this method is a mixture of a cross-linked type polyester resin formed by using 60 mol % or more of propylene glycol with respect to a total alcohol component, and a straight chain type polyester resin. However, it is still difficult to provide a sufficient fixing temperature range using the toner prepared in this manner.

DISCLOSURE OF THE INVENTION

An illustrative embodiment of the present invention provides a toner capable of preventing hot offset and a method of preparing the toner.

Another illustrative embodiment of the present invention also provides an electrophotographic image forming apparatus using the toner.

According to an aspect of the present invention, there is provided a toner comprising: a binder resin (A); a cross-linked resin having a THF insoluble content of 99-100 wt %; a colorant; and at least one additive, wherein the cross-linked resin is arranged in the form of a plurality of islands.

According to another aspect of the present invention, there is provided a method of preparing a toner, comprising: preparing a toner mixture solution by mixing a binder resin (A), a colorant, and at least one additive to an organic solvent; forming a toner micro-suspension by adding the toner mixture solution to a dispersion medium; forming a toner composition by removing the organic solvent from the toner micro-suspension; and forming a toner composite in which a cross-linked resin is arranged in the form of a plurality of islands, by mixing the toner composition with the cross-linked resin micro-suspension and aggregating and melt-adhering the mixture.

According to another aspect of the present invention, there is provided an electrophotographic image forming apparatus comprising a toner according to one of the above embodiments.

BEST MODE

Hereinafter, the present invention will now be described more fully with reference to exemplary embodiments of the invention.

A toner according to an embodiment of the present invention includes a binder resin (A), a cross-linked resin having a THF (tetrahydrofuran) insoluble content of 99-100 wt %, a colorant, and at least one additive, wherein the cross-linked resin is arranged in each of toner particles in the form of a plurality of islands. Also, the cross-linked resin is formed by a cross-linking reaction of a resin (B) having an active hydrogen-containing group and a cross-linking agent.

First, a binder resin (A) is described.

The binder resin (A) includes a polyester resin, which is advantageous in terms of dispersibility and low temperature fixing property of the colorant. The polyester resin may be prepared by poly-condensation by heating polyhydric alcohol components and polybasic carboxylic acid components under reduced pressure or in the presence of a catalyst. Examples of the polyhydric alcohol components are polyoxyethylene-(2.0)-2,2-bis(4-hydroxyphenyl)propane,
polyoxypropylene-(2.0)-2,2-bis(4-hydroxyphenyl)propane,
polyoxypropylene-(2.2)-polyoxyethylene-(2.0)-2,2-bis(4-hydroxyphenyl)propane,
polyoxyethylene-(2.3)-2,2-bis(4-hydroxyphenyl)propane,
polyoxypropylene-(6)-2,2-bis(4-hydroxyphenyl)propane,
polyoxypropylene-(2.3)-2,2-bis(4-hydroxyphenyl)propane,
polyoxypropylene-(2.4)-2,2-bis(4-hydroxyphenyl)propane,
polyoxypropylene-(3.3)-2,2-bis(4-hydroxyphenyl)propane,
polyoxyethylene-(6)-2,2-bis(4-hydroxyphenyl)propane, ethylene glycol, 1,3-propylene glycol,
1,2-propylene glycol, 1,4-butylene glycol, 1,3-butylene glycol, glycerol, and polyoxypropylene.

Examples of the polybasic carboxylic acid components are an aromatic polybasic acid and/or an alkyl ester thereof that are commonly used in the preparation of the polyester resin. Examples of the aromatic polybasic acid are terephthalic acid, isophthalic acid, trimellitic acid, pyromellitic acid, 1,2,4-cyclohexane tricarboxylic acid, 2,5,7-naphthalene tricarboxylic acid, 1,2,4-naphthalene tricarboxylic acid, 1,2,5-hexane tricarboxylic acid, 1,2,7,8-octane tetracarboxylic acid, and/or alkyl esters of these carboxylic acids, wherein the alkyl group may be a methyl group, an ethyl group, a propyl group and a butyl group. The aromatic polybasic acid and/or alkyl esters thereof may be used alone or in a combination of two or more of them.

The content of the binder resin (A) is 50-98 parts by weight based on 100 parts by weight of the total toner composition. When the content is less than 50 parts by weight, the amount of the binder resin (A) is insufficient for binding the toner composition. On the other hand, when the content is higher than 98 parts by weight, the amount of the toner composition except for the binder resin (A) is too small to preserve the function of the toner. Here, "total toner composition" refers to the toner composition including a colorant, an additive, and an external additive, which will be described later, in addition to the binder resin (A) and the cross-linking agent. The binder resin (A) has a number average molecular weight of 1000-4000, and a poly dispersity index (PDI) of 2-15, and a THF insoluble content of 1 wt % or less. When the number average molecular weight is less than 1000, the melt viscosity is too small and the fixing temperature range becomes too narrow. On the other hand, when the number average molecular weight is greater than 4000, large particles are formed, causing a wide particle size distribution. Also, when PDI is less than 2, the fixing temperature range becomes too narrow, and when the PDI is larger than 15, it is difficult to obtain a resin having a THF insoluble content of 1 wt % or less. When the THF insoluble content is greater than 1 wt %, it is difficult to prepare micro-suspension particles. Also, the binder resin (A) may be the resin (B) having an active hydrogen-containing group, which will be described later, or a resin including the resin (B).

Hereinafter, the resin (B) having an active hydrogen-containing group will be described.

The active hydrogen-containing group includes at least one selected from the group consisting of a hydroxyl group (OH), a mercapto group (SH), a carboxylic group, a phosphate group, a sulfonate group, and a sulfate group, which are capable of being easily bound to an isocyanate compound or an epoxy compound as will be described later. Among these, a resin having a hydroxyl group and/or a carboxylic group is advantageous for reaction with the cross-linking agent. The resin (B) may be, for example, a polyester resin containing an active hydrogen-containing group.

The cross-linking agent undergoing a cross-linking reaction with the resin (B) is an isocyanate compound or an epoxy compound, preferably, an isocyanate compound.

Examples of the isocyanate compound are aromatic, aliphatic and/or alicyclic isocyanate compounds that are well known in the art, tri-functional isocyanate compounds, and isocyanate functional adducts of polyol and diisocyanate compounds. Examples of the commonly useful diisocyanate compounds are 1,6-hexamethylene diisocyanate, isophorone diisocyanate, 4,4-biphenylene diisocyanate, toluene diisocyanate, bis-cyclohexyl diisocyanate, tetramethylene xylene diisocyanate, ethyl ethylene diisocyanate, 2,3-dimethyl ethylene diisocyanate, 1-methyltrimethylene diisocyanate, 1,3-phenylene diisocyanate, 1,5-naphthalene diisocyanate, bis-(4-isocyanatocyclohexyl)-methane, and 4,4-diisocyanatodiphenyl ether, and so forth. Examples of the tri-functional isocyanate compounds are triphenylmethane triisocyanate, 1,3,5-benzene triisocyanate, and 2,4,6-toluene triisocyanate, and so forth. Also, timers of diisocyanate such as trimer of hexamethylene diisocyanate and trimer of isophorone diisocyanate, which are sold under the registered trade mark "Desmodur N-3390", may be used. Bifunctional cross-linking agents of the above may be used with tri-functional adducts such as triol. Also, the polyisocyanate that is block-copolymerized using a phenol derivative, oxime, and/or caprolactam may be used, or two or more types of the polyisocyanate may be used in combination.

Examples of the epoxy compounds are diphenylolpropane type epoxy resin, diphenylolmethane type epoxy resin, Novolac type epoxy resin, diamine type epoxy resin, diacid type epoxy resin, and diol type epoxy resin, which have two to five epoxy functional groups.

The content of the cross-linking agent is 0.004 to 0.15 mol with respect to 1 mol of the active hydrogen-containing group, preferably, 0.008 to 0.075 mol. When the content is less than 0.004 mol, the cross-linking density is low and thus storage stability at high temperature is not sufficient, and resistance to hot offset property is degraded, thereby reducing the fixing temperature range. When the content is higher than 0.15 mol, components of high molecular weights due to the cross-linking are increased, thereby deteriorating the fixing property at a low temperature.

A cross-linked resin is formed by the cross-linking reaction between the resin (B) and the cross-linking agent, and the cross-linked resin is arranged in the form of a plurality of islands in the toner composition including the binder resin (A), the colorant, and an additive by using the method of preparing a toner, which will be described later. The content of the cross-linked resin included in the toner is generally 10-20 parts by weight based on 100 parts by weight of the binder resin (A). When the content of the cross-linked resin is less than 10 parts by weight, the molecular weight becomes too small, thereby reducing the fixing temperature range. When the content is greater than 20 parts by weight, the resin becomes too rigid and is not advantageous to the fixing properties at low temperature. Also, a THF insoluble part of the cross-linked resin may be 99-100 wt %. When the THF insoluble part is less than 99 wt %, the cross-linking density is low and thus the resistance to hot offset property is insufficient.

Meanwhile, the colorant may be used not in the form of a pigment itself, but in the form of a pigment master batch in which the pigment is dispersed in a resin. Thus, by using the pigment mater batch, the exposure of the surface of the colorant is suppressed, thereby improving the charging performance of the toner particles.

The above-described binder resin (A) and/or the resin (B) having an active hydrogen-containing group may be used as a resin for the pigment master batch. The pigment master batch refers to a resin composition in which a pigment is evenly dispersed, and is prepared by blending the pigment and the resin at high temperature and high pressure, or by dissolving the resin in a solvent, and adding the pigment to the solution, then applying a high shearing force to disperse the pigment. By suppressing the exposure of pigment while preparing toner micro-suspension solution using the pigment master batch, a homogenous micro-suspension solution may be prepared. The content of the pigment used in the present embodiment is 10 to 60 parts by weight based on 100 parts by weight of the total pigment master batch, preferably, 20-40 parts by weight. If the content of the pigment is lower than 10 parts by weight, a desired color may not be achievable during printing due to the insufficient amount of the pigment in the toner, and if the content of the pigment is greater than 60 parts by weight, the pigment dispersion within the pigment master batch is not likely to be homogenous, and is therefore not desirable.

The pigment may be selected appropriately from pigments widely commercially used, such as a black pigment, a cyan pigment, a magenta pigment, a yellow pigment, and a mixture thereof.

Examples of such pigment types are as follows. The black pigment may be titanium oxide or carbon black. The cyan pigment may be copper phthalocyanine compound and derivatives thereof, anthraquine compound, or a base dye lake compound. Specifically, the cyan pigment may be C.I. pigment blue 1, 7, 15, 15:1, 15:2, 15:3, 15:4, 60, 62, 66, or the like. The magenta pigment may be condensed nitrogen compound, anthraquine, quinacridone compound, base dye lake compound, naphthol compound, benzo imidazole compound, thioindigo compound, or perylene compound. Specifically, the magenta pigment may be C.I. pigment red 2, 3, 5, 6, 7, 23, 48:2, 48:3, 48:4, 57:1, 81:1, 144, 146, 166, 169, 177, 184, 185, 202, 206, 220, 221, 254, or the like. The yellow pigment may be condensed nitrogen compound, isoindolinone compound, anthraquine compound, azo metal composite, or allyl imide compound. Specifically, the yellow pigment may be C.I. pigment yellow 12, 13, 14, 17, 62, 74, 83, 93, 94, 95, 109, 110, 111, 128, 129, 147, 168 or the like.

The amount of the colorant may be an amount sufficient to color the toner and form a visible image by development. In this regard, the content of the colorant may preferably be 3-15 parts by weight based on 100 parts by weight of the binder resin (A). If the content of the colorant is less than 3 parts by weight, a coloring effect is insufficient, and if the content of the colorant is greater than 15 parts by weight, the electrical resistance of the toner is low, such that sufficient frictional charge amount cannot be obtained, thereby causing contamination.

Meanwhile, the additive may be a charge control agent, a releasing agent, or a mixture of thereof.

The charge control agent may be a negative charge control agent or a positive charge control agent. The negative charge control agent may be an organic metal composite or chelate compound such as chromium-containing azo composite or a mono azo metal composite; a salicylic acid compound containing metal such as chromium, iron, or zinc; or an organic metal complex of an aromatic hydroxycarboxylic acid and an aromatic dicarboxylic acid. However, the negative charge control agent is not particularly limited insofar as it is conventionally used. Moreover, the positive charge control agent may be Nigrosine and products of Nigrosine, modified with a fatty acid metal salt, and an onium salt including a quaternary ammonium salt such as tributylbenzylammonium 1-hydroxy-4-naphthosulfonate and tetrabutylammonium tetrafluoroborate, individually or as a mixture of two or more types. Such a charge control agent charges the toner stably and rapidly by electrostatic force, and thus stably supports the toner on a developing roller.

The content of the charge control agent included in the toner may generally be within the range of 0.1 to 10 parts by weight based on 100 parts by weight of the total toner composition. When the content of the charge control agent is less than 0.1 parts by weight, the charging speed of the toner is low and the charging amount is low, and thus it is not sufficient to function as a charge control agent. When the content of the charge control agent is greater than 10 parts by weight, the charging amount is too great, which is likely to cause image distortion.

The releasing agent may enhance the fixing property of the toner image and may be a polyalkylene wax such as low molecular weight polypropylene wax and low molecular weight polyethylene wax, ester wax, carnauba wax and paraffin wax. The content of the releasing agent included in the toner is generally 0.1 to 30 parts by weight based on 100 parts by weight of the total toner composition. When the content of the releasing agent is less than 0.1 parts by weight, it is not easy to realize oil-less fixing in which toner particles are fixed without using oil. On the other hand, when the content of the releasing agent is greater than 30 parts by weight, toner may be flocculated during storage.

Furthermore, the additive may further include external additives. External additives may be used to improve fluidity of toner or control charging properties of the toner, and may include large particulate silica, small particulate silica and polymer beads.

Hereinafter, the present invention will be described more in detail with reference to a method of preparing the toner, according to the current embodiment of the present invention.

First, a polar solvent, a surfactant, and a thickener (if required) are mixed, stirred, and heated to sufficiently dissolve solid components of the mixture, thereby preparing a dispersion medium. When it is observed that the solid components have dissolved sufficiently, an organic solvent is added to the dispersion medium to prepare a milky-white liquid composition. Then, the resin including an active hydrogen-containing group and a cross-linking agent are added and mixed to the liquid composition to prepare a micro-suspension.

Next, by stirring and heating the micro-suspension, preferably under partially reduced pressure, the organic solvent is removed. As a result, a cross-linked resin micro-suspension is obtained.

Next, the binder resin, the colorant, and at least one additive are mixed in the organic solvent to prepare a toner mixture solution. Meanwhile, when the binder resin has an acid group, the acid group of the binder resin is neutralized using a base.

Next, the toner mixture solution is added to the dispersion medium formed of the polar solvent, the surfactant, and a thickener (if required), and stirred to prepare a toner micro-suspension.

Then, the toner micro-suspension is stirred and heated, preferably at a partially reduced pressure, to remove the organic solvent. As a result, a toner composition is obtained.

Then, the cross-linked resin micro-suspension and the toner composition are mixed, and the prepared toner composition is aggregated by adding an aggregating agent and controlling the temperature and the pH. As a result, a toner composite is obtained. In this case, the toner composite has a low rigidity, and the shape of the toner composite is very irregular.

Then, the aggregated toner composite is melt-adhered to obtain a toner composite having a desired particle size. By way of such melt-adhesion, the rigidity of the toner composite is increased, and the shape becomes regular. In addition, the shape of the toner composite may change to a range of shapes from a contorted sphere to a perfect sphere depending on the degree of the melt-adhesion. Particularly, by this melt-adhesion, a toner composite in which the cross-linked resin is arranged irregularly in the form of a plurality of islands is obtained. That is, the binder resin (A) is aggregated by the melt-adhesion; however, since the cross-linked resin is of a relatively low amount and is insoluble in an organic solvent such as THF, the cross-linked resin is not fused with the binder resin (A) and is stuck in the form of islands in the toner composite.

Finally, the melt-adhered toner composite is cooled, and washed and dried to obtain toner particles.

The organic solvent used in the above preparation method is volatile, has a lower boiling point than polar solvents, and does not mix with polar solvents, and may include at least one type selected from the group consisting of esters such as methyl acetate or ethyl acetate; ketones such as acetone or methylethyl ketone; hydrocarbons such as dichloromethane or tricholoroethane; and aromatic hydrocarbons such as benzene.

The polar solvent may be at least one selected from the group consisting of water, glycerol, ethanol, ethylene glycol, propylene glycol, diethylene glycol and dipropylene glycol, sorbitol, and preferably water.

The thickener may be polyvinyl pyrrolidone, polyvinyl alcohol, polyacrylic acid, gelatin, chitosan and sodium alginate.

The surfactant may include at least one selected from the group consisting of a nonionic surfactant, an anionic surfactant, a cationic surfactant and an amphoteric surfactant.

Examples of the nonionic surfactant are polyvinyl alcohol, polyacrylic acid, methycellulose, ethylcellulose, propylcellulose, hydroxyethylcellulose, carboxymethylcellulose, polyoxyethylene cetyl ether, polyoxyethylene lauryl ether, polyoxyethylene octylphenyl ether, polyoxyethylene stearyl ether, polyoxyethylene norylphenyl ether, ethoxylate, phosphate norylphenols, triton, and dialkylphenoxypoly(ethyleneoxy)ethanol. Examples of the anionic surfactant are sodium dodecyl sulfate, sodium dodecyl benezene sulfonate, sodium dodecyl naphthalene sulfate, dialkyl benzenealkyl sulfate, and sulfonate. Examples of the cationic surfactant are alkyl benzene dimethyl ammonium chloride, alkyl trimethyl ammonium chloride, and distearyl ammonium chloride. Examples of the amphoteric surfactant are amino acid amphoteric surfactant, betaine amphoteric surfactant, lecitin, taurin, cocoamidopropylbetaine, and disodium cocoamphodiacetate. The surfactants described above may be used alone or in combination of two or more.

When the binder resin has an acid group, a base used in neutralizing the acid groups, that is, a neutralizer may be, for example, hydroxide of alkaline metals such as sodium hydroxide or lithium hydroxide, carbonate of alkaline metals such as sodium, potassium, and lithium; alkaline metal acetate; ammonium hydroxide; or alkanolamines such as methylamine, or dimethylamine. Among these, hydroxides of alkaline metals are preferable.

The neutralizer may be used at 0.1-3.0 g equivalents, preferably 0.5-2.0 g equivalents, per 1 g equivalent of the acid group of the binder resin with acid groups.

The aggregating agent of the toner composite may be a monovalent or higher inorganic metal salt.

Generally, since the aggregating ability increases as the ionic charge number increases, an appropriate aggregating agent needs to be selected in consideration of the aggregating speed of the dispersion solution or the stability of the method of preparation. Examples of the monovalent or higher inorganic metal salt are calcium chloride, calcium acetate, barium chloride, magnesium chloride, sodium chloride, sodium sulfate, ammonium sulfate, magnesium sulfate, sodium phosphate, sodium dihydrophosphate, ammonium chloride, cobalt chloride, strontium chloride, cesium chloride, nickel chloride, rubidium chloride, potassium chloride, sodium acetate, ammonium acetate, potassium acetate, sodium benzoate, aluminum chloride and zinc chloride.

The toner prepared by a method according to an embodiment of the present invention may be applied to an electrophotographic image forming device. Here, the electrophotographic image forming device may be a laser printer, a photocopier or a facsimile.

The present invention will be described in further detail with reference to the following examples. These examples are for illustrative purposes only and are not intended to limit the scope of the present invention.

EXAMPLES

Synthesis of Polyester Resin Having an Active Hydrogen-Containing Group

Preparation Example 1

Synthesis of Polyester Resin 1

A 3 L reactor equipped with a stirrer, a thermometer and a condenser was installed in an oil bath in which the oil is a heat transfer medium. A variety of monomers, in detail, 50 g of dimethyl terephthalate, 47 g of dimethyl isophthalate, 80 g of 1,2-propylene glycol and 3 g of trimellitic acid were added to the reactor. Then, 0.09 g of dibutyl tin oxide was added thereto as a catalyst at a ratio of 500 ppm with respect to the total weight of the monomers. Then, the reaction mixture was heated to 150° C. while stirring the mixture at a speed of 150 rpm. The reaction was performed for about 6 hours, and the reaction temperature was increased to 220° C. The pressure of the reactor was reduced to 0.1 torr in order to remove the byproducts, and the reaction was completed after the pressure was maintained at this level for 15 hours. As a result, polyester resin 1 was obtained.

The glass transition temperature (Tg) of the polyester resin 1 measured using a differential scanning calorimeter (DSC) was 62° C. In addition, the softening temperature (Ts) of the polyester resin 1 measured using a flow tester CFT-500 (Shimadzu Co.) was 156° C. Gel permeation chromatography (GPC) using polystyrene as a standard sample was used to measure the number average molecular weight and poly dispersity index (PDI) of the polyester resin 1 which were 4,300 and 3.5, respectively. The content of the active hydrogen-containing group measured by titration was 0.4 mmolKOH/g.

Preparation Example 2

Synthesis of Polyester Resin 2

Polyester resin 2 was prepared in the same manner as in Preparation Example 1, except that the process of removing byproducts was performed for 10 hours. The Tg of the polyester resin 2 measured using a DSC after the reaction was 58° C. The Ts of the polyester resin 2 measured using a flow tester CFT-500 was 138° C. The number average molecular weight and PDI of the polyester resin 2 which were measured by GPC using polystyrene as a standard sample were respectively 2,100 and 3.4. The content of the active hydrogen-containing group measured by titration was 0.2 mmolKOH/g.

Preparation of Pigment Master Batch

Preparation Example 3

Preparation of Black Pigment Master Batch

The polyester resin synthesized in Preparation Example 1 and a carbon black pigment (Degussa GmbH of Germany, NIPEX 150) were mixed in a weight ratio of 8:2. Then, 50 parts by weight of ethyl acetate was added to 100 parts by weight of the polyester resin and the mixture was heated to about 60° C., and then stirred with a kneader for 60 minutes. Then, while the mixture was stirred at a speed of 50 rpm using a biaxial extruder having a vacuum device, ethyl acetate as a solvent was removed using the vacuum device to obtain a black pigment master batch.

Preparation of Cross-Linked Resin

Preparation Example 4

To 1 L reactor equipped with a condenser, a thermometer, and an impeller stirrer, 400 g of distilled water, 20 g of polyvinyl alcohol (P-24™, DC Chemical Co. of Seoul, Korea), and 14 g of a neutral surfactant (Tween 20™, Aldrich Chemical Company of Milwaukee, Wis.), and 4 g of sodium dodecylsulfate (Aldrich Chemical Company), as an anionic surfactant, were added and heated at a stirring speed of 500 rpm at 70° C. to dissolve solid components sufficiently. After the solid components were completely dissolved, 100 g of methylethylketone (Aldrich Chemical Company) was mixed thereto, and a milky-white liquid composition was obtained. Then, 120 g of the polyester resin (2) synthesized in Preparation Example 2 and 6 g of isocyanate cross-linking agent (toluene diisocyanate, Aldrich Chemical Company) was added in an amount of 0.07 mol with respect to 1 mol of the active hydrogen-containing group included in the polyester resin (2), and then stirred at a speed of 1000 rpm and mixed for five hours at 75° C. under reflux to prepare a micro-suspension. Next, by reducing the stirring speed to 300 rpm and increasing the temperature of the reactor to 90° C., methylethylketone, which is an organic solvent, was removed from the reactor under a partially reduced pressure of 100 mmHg, and then obtained through the condenser. After 4 hours, the amount of the obtained methylethylketone was checked to see that the added methylethylketone is removed completely. Next, the temperature of the reactor is cooled to 25° C. to obtain a cross-linked resin micro-suspension. The volume average particle diameter of the cross-linked resin micro particles was 300 nm, and the THF insoluble content was 99 wt %.

Here, the THF insoluble content (wt %) refers to the mass of the cross-linked resin that is not soluble in THF (tetrahydrofuran) among the total mass of the cross-linked resin sample in weight %, and this test is for measuring the cross-linking density of the polyester. In detail, 10 g of the cross-linked resin was weighed in units of g, down to three decimal places and added to 100 ml of THF and stirred for two hours and dissolved, and left to stand for 22 hours. Then, the solution was filtered using a 200 mesh filter formed of stainless steel and the amount of the remaining resin was marked.

Preparation Example 5

A cross-linked resin micro-suspension solution was obtained in the same manner as Preparation Example 4 except that 120 g of the polyester resin (2) synthesized in Preparation Example 2 and 0.25 g of a cross-linking agent (toluene diisocyanate of Aldrich Chemical Company) were used. Here, 0.25 g of the cross-linking agent corresponds to 0.003 mol with respect to 1 mol of the active hydrogen-containing group included in the polyester resin (2).

Preparation Example 6

A cross-linked resin micro-suspension solution was obtained in the same manner as Preparation Example 4 except that 120 g of the polyester resin (2) synthesized in Preparation Example 2 and 30 g of a cross-linking agent (toluene diisocyanate of Aldrich Chemical Company) were used. Here, 30 g of the cross-linking agent corresponds to 0.35 mol with respect to 1 mol of the active hydrogen-containing group included in the polyester resin (2).

Preparation of Toner Particles

Example 1

60 g of the polyester resin (1) synthesized in Preparation Example 1, 40 g of black pigment master batch synthesized in Preparation Example 3, 1 g of a charge control agent (N-23; HB Dinglong Co.), 4 g of paraffin wax, and 150 g of methylethyl ketone as an organic solvent were added to a 1 L reactor equipped with a condenser, a thermometer, and an impeller stirrer to prepare a toner mixture solution. While the mixture solution was stirred at a speed of 600 rpm, 25 ml of 1N NaOH solution was added thereto. Then, the mixture solution was mixed at 80° C. for 5 hours while refluxing. When the mixture solution has sufficient fluidity, it was further stirred at 500 rpm for 2 hours.

600 g of distilled water, 5 g of a neutral surfactant (Tween 20, Aldrich Co.), and 1 g of sodium dodecyl sulfate (Aldrich Co.) as an anionic surfactant were added to a separate 3 L reactor equipped with a condenser, a thermometer and an impeller stirrer, and the mixture was stirred at 85° C. at 600 rpm for 1 hour to obtain a dispersion medium.

The toner mixture was added to the dispersion medium and stirred at the same temperature, i.e., 85° C., at 1000 rpm for 1 hour to prepare a toner micro-suspension.

Then, methylethyl ketone as an organic solvent was removed under a partially reduced pressure of 100 mmHg while the reactor was heated to 90° C. Thus, a toner composition was obtained. The size of the toner composition in which methylethyl ketone was removed was measured using a Coulter Multisizer (Beckman Coulter Co.), and the volume average particle size was 400 nm.

Next, the contents of the reactor including the toner composition was added to the reactor containing the cross-linked resin micro-suspension prepared in Preparation Example 4.

Then, 10 g of magnesium chloride was dissolved in 50 g of distilled water and slowly added to the reactor to aggregate the mixture of the cross-linked resin particles and the toner composition while raising the temperature to 80° C. for 30 minutes. Thus a toner composite was obtained. After 5 hours, the size of the toner composite was measured using a Coulter Multisizer (Beckman Coulter Co.) and the volume average particle size was 6.7 μm.

Then, melt-adhesion was performed at 80° C. for 8 hours by adding 500 g of distilled water to the reactor, and then cooling the reactor.

Then, the melt-adhered toner composite was separated using a filter that is commonly used in the art, washed with 1 N hydrochloric acid solution, and then washed 5 times with distilled water to completely remove a surfactant and the like. The washed toner composite was dried in a fluidized bed dryer at 40° C. for 5 hours to obtain dried toner particles.

As a result of analyzing the toner particles, the obtained toner particles had a volume average particle size of 6.8 μm and a 80% span value of 0.65. In addition, as a result of analyzing 100 random toner particle samples by Image J software using a scanning electron microscope (SEM; JEOL Ltd.), a mean shape factor was determined to be 0.91.

Comparative Example 1

Toner particles were prepared in the same manner as in Example 1, except that the cross-linked resin prepared in Preparation Example 5 was used.

As a result of analyzing the toner particles, the obtained toner particles had a volume average particle size of 7.0 μm and a 80% span value of 0.64. In addition, as a result of analyzing 100 random toner particle samples by Image J software using a scanning electron microscope (SEM; JEOL Ltd.), a mean shape factor was determined to be 0.90.

Comparative Example 2

Toner particles were prepared in the same manner as in Example 1, except that the cross-linked resin prepared in Preparation Example 6 was used.

As a result of analyzing the toner particles, the obtained toner particles had a volume average particle size of 6.8 μm and a 80% span value of 0.64. In addition, as a result of analyzing 100 random toner particle samples by Image J software using a scanning electron microscope (SEM; JEOL Ltd.), a mean shape factor was determined to be 0.90.

Comparative Example 3

Toner particles were prepared in the same manner as in Example 1, except that the mixing of the obtained toner composition to the cross-linked resin micro-suspension prepared in Preparation Example 4 was omitted. That is, the cross-linked resin micro-suspension was not used.

As a result of analyzing the toner particles, the obtained toner particles had a volume average particle size of 6.5 μm and a 80% span value of 0.65. In addition, as a result of analyzing 100 random toner particle samples by Image J software using a scanning electron microscope (SEM; JEOL Ltd.), a mean shape factor was determined to be 0.85.

Volume average particles sizes of the toner according to Examples 1, Comparative Example 1, and Comparative Example 2 and Comparative Example 3 were measured using a Coulter Multisizer 3. An aperture of 100 μm was used in the Coulter Multisizer, an appropriate amount of a surfactant was added to 50 to 100 ml of ISOTON-II (Beckman Coulter Co.) as an electrolyte, and 10 to 15 mg of toner particles to be measured was added thereto, and the resultant was dispersed in a ultrasonic dispersing apparatus for 5 minutes to prepare a sample for the Coulter Multisizer.

In addition, the 80% span value which is an index that determines the particle size distribution was calculated by Equation 1 below. The volume of toner particles is accumulated from particles of the smallest size in ascending order until the accumulated volume reaches 10% of the total volume of the toner. An average particle size of the accumulated particles corresponding to 10% of the total volume of the toner is defined as d10, an average particle size of the accumulated particles corresponding to 50% of the total volume of the toner is defined as d50, and an average particle size of the accumulated particles corresponding to 90% of the total volume of the toner is defined as d90.

$$80\% \text{ span value}=(d90-d10)/d50 \quad \text{Equation 1}$$

Here, a smaller span value indicates a narrower particle size distribution, and a larger span value indicates a wider particle size distribution.

In addition, the shape factor was calculated by Equation 2 below by measuring SEM images (×1,500) of 100 random toner particles and analyzing them using Image J software.

$$\text{Shape factor}=4\pi(\text{area}/(\text{perimeter})^2) \quad \text{Equation 2}$$

Here, the area indicates a projected area of the toner and the perimeter indicates a projected circumference of the toner. The shape factor may be in the range of 0 to 1, the closer the value is to 1, the more spherical the shape is.

Meanwhile, a method of evaluating resins is as follows.

Using a differential scanning calorimeter (Model STA 409 manufactured by Netzsch Co.), the temperature of a sample was increased from 20 to 200° C. at 10° C./min, rapidly cooled to 10° C. at 20° C./min, and heated at 10° C./min to measure a glass transition temperature (Tg).

A softening temperature (Ts) was measured using a flow tester CFT-500 (Shimadzu Co.), and a temperature at which a half of a 1.5 g sample flows out through a nozzle having a diameter of 1.0 mm and a length of 10 mm under the condition of a 10 Kgf load and 6° C./min of heating speed was defined as Ts.

The content of the active hydrogen-containing group is calculated by adding the content of the acid group to the content of the hydroxyl group as follows.

First, the content of the acid group (mmol KOH/g) is obtained by dissolving 0.5-2 g of a resin in 100 ml of dichloromethane and cooling the same, and titrating with a 0.1N KOH methyl alcohol solution using a titration device (Metrohm 736 GP Titrino, Metrohm Ltd.), and measuring the amount S (ml) of the 0.1N KOH methyl alcohol solution used for titration and the weight W (g) of the resin used, using Equation 3 below.

$$\text{The content of the acid group(mmol KOH/g)}=S/(W\times 10) \quad \text{Equation 3}$$

Next, the content of the hydroxyl group (mmol KOH/g) was calculated as follows. First, 0.5-2 g of a resin was mixed with 1-2 g of anhydrous acetic acid and 3-4 g of pyridine, heated for 1 hour at 90-100° C., and cooled. 1-2 ml of water was added thereto to dissolve any anhydrous acetic acid which was not reacted. Then, 100 ml of dichloromethane was added to the solution and then the amount S'(ml) of the 0.1N KOH methyl alcohol solution used for titration and the weight W'(g) of the used resin were measured by titrating in the same manner as the measurement of the acid group using 0.1N KOH methyl alcohol solution. Also, only without the resin, a blank test was performed to measure the amount B (ml) of 0.1N KOH methyl alcohol solution used for titration and the content of the hydroxyl group, using Equation 4 below.

$$\text{The content of the hydroxyl group(mmol KOH/g)}=(B-S')/(W'\times 10)+\text{the content of the acid group} \quad \text{Equation 4}$$

Hereinafter, the toner particles prepared in the above examples and comparative example were examined as follows.

Fixing temperature range: Resistance to hot offset 100 g of toner, 2 g of silica (TG 810G; Cabot Co.) and 0.5 g of silica (RX50, Degussa GmbH) were mixed to prepare a toner with external additives. Using the toner with external additives, unfixed solid images of 30 mm×40 mm were prepared by a Samsung CLP-510 printer. Then, the fixing properties of the unfixed images were evaluated while varying the temperature of a fixing roller at a fixing tester in which the fixing temperature could be controlled.

The result of the above test is shown in Table 1 below.

TABLE 1

| Examples or Comparative Example No. | Fixing temperature range(° C. ) |
|---|---|
| Example 1 | 130~210 |
| Comparative Example 1 | 150~190 |
| Comparative Example 2 | 160~210 |
| Comparative Example 3 | 140~180 |

Referring to Table 1, the range of the fixing temperature of Example 1 was 130-210° C., and that of Comparative Example 3 was 140-180° C., indicating that the fixing temperature range of Example 1 of the present invention is broader (the low fixing temperature was lower and the high fixing temperature was higher) than that of Comparative Example 3. However, in Comparative Example 1 in which the cross-linking agent was used at a ratio of less than 0.004 mol with respect to 1 mol of the active hydrogen-containing group, the fixing temperature range at low temperature was narrower and the fixing temperature range at high temperature was wider than those of Comparative Example 3. In the same manner, in Comparative Example 2 in which the cross-linking agent was used at a ratio of more than 0.15 mol with respect to 1 mol of the active hydrogen-containing group, the fixing temperature range at low temperature was narrower and the fixing temperature at high temperature was wider than those of Comparative Example 3. Accordingly, when the cross-linking agent of an appropriate amount is used, the fixing temperature range at high temperature is broader compared to when no cross-linking agent at all is used, thereby increasing the resistance to hot offset and increasing the fixing temperature range at low temperature. When the cross-linking agent is not used within an appropriate amount, the fixing properties at low temperature are degraded compared to when using no cross-linking agent at all is used, but the fixing properties at high temperature are improved.

While the present invention has been particularly shown and described with reference to exemplary embodiments thereof, it will be understood by one of ordinary skill in the art that various changes in form and details may be made therein without departing from the spirit and scope of the present invention as defined by the following claims.

The invention claimed is:

1. A toner comprising:

a binder resin (A);

a cross-linked resin having a THF insoluble content of 99-100 wt % with respect to tetrahydrofuran (THF);

a colorant; and at least one additive, wherein the cross-linked resin is arranged in the form of a plurality of islands, wherein the cross-linked resin is formed by a cross-linking reaction of a resin (B) having an active hydrogen-containing group, and a cross-linking agent, wherein the content of the cross-linking agent is in an amount of 0.004 to 0.15 mol with respect to 1 mol of the active hydrogen-containing group.

2. The toner of claim 1, wherein the resin (B) having an active hydrogen-containing group is a polyester resin including at least one selected from the group consisting of a hydroxyl group, a mercapto group, a carboxyl group, a phosphate group, a sulfonate group, and a sulfate group.

3. The toner of claim 1, wherein the cross-linking agent is an isocyanate compound or an epoxy compound.

4. The toner of claim 1, wherein the content of the cross-linked resin is 10 to 20 parts by weight with respect to 100 parts by weight of the binder resin (A).

5. The toner of claim 1, wherein the colorant is in the form of a pigment master batch.

6. A method of preparing a toner, comprising:

preparing a toner mixture solution by mixing a binder resin (A), a colorant, and at least one additive to an organic solvent;

forming a toner micro-suspension by adding the toner mixture solution to a dispersion medium;

forming a toner composition by removing the organic solvent from the toner micro-suspension; and forming a toner composite in which a cross-linked resin is arranged in the form of a plurality of islands, by mixing the toner composition with a cross-linked resin micro-suspension and aggregating and melt-adhering the mixture.

7. The method of claim 6, wherein the cross-linked resin micro-suspension is formed by forming a micro-suspension by mixing a resin (B) having an active hydrogen-containing group, a cross-linking agent, and an organic solvent in a dispersion medium, and heating the micro-suspension to remove the organic solvent.

8. The method of claim 7, wherein the resin (B) having an active hydrogen-containing group is a polyester resin containing at least one selected from the group consisting of a hydroxyl group, a mercapto group, a carboxyl group, a phosphate group, a sulfonate group, and a sulfate group.

9. The method of claim 7, wherein the cross-linking agent is an isocyanate compound or an epoxy compound.

10. The method of claim 7, wherein the content of the cross-linking agent is in an amount of 0.004 to 0.15 mol with respect to 1 mol of the active hydrogen-containing group.

11. The method of claim 6, wherein the content of the cross-linked resin is 10 to 20 parts by weight with respect to 100 parts by weight of the binder resin (A).

12. The method of claim 6, wherein the cross-linked resin has a THF insoluble content of 99-100 wt %.

13. The method of claim 6, wherein the colorant is used in the form of a pigment master batch.

14. An electrophotographic image forming apparatus comprising a toner having:

a binder resin (A);

a cross-linked resin having a THF insoluble content of 99-100 wt % with respect to tetrahydrofuran (THF);

a colorant; and at least one additive, wherein the cross-linked resin is arranged in the form of a plurality of islands, wherein the cross-linked resin is formed by a cross-linking reaction of a resin (B) having an active hydrogen-containing group, and a cross-linking agent, wherein the content of the cross-linking agent is an amount of 0.004 to 0.15 mol with respect to 1 mol of the active hydrogen-containing group.

* * * * *

UNITED STATES PATENT AND TRADEMARK OFFICE

CERTIFICATE OF CORRECTION

PATENT NO. : 8,389,188 B2
APPLICATION NO. : 12/739699
DATED : March 5, 2013
INVENTOR(S) : Kim et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 355 days.

Signed and Sealed this
First Day of September, 2015

Michelle K. Lee

Michelle K. Lee
*Director of the United States Patent and Trademark Office*